US009072332B2

(12) United States Patent
De Harde

(10) Patent No.: US 9,072,332 B2
(45) Date of Patent: Jul. 7, 2015

(54) SPORT HELMETS

(76) Inventor: Barend Hendrik De Harde, Johannesburg (ZA)

( * ) Notice: Subject to any disclaimer, the term of this patent is extended or adjusted under 35 U.S.C. 154(b) by 651 days.

(21) Appl. No.: 13/141,280

(22) PCT Filed: Dec. 21, 2009

(86) PCT No.: PCT/IB2009/055872

§ 371 (c)(1),
(2), (4) Date: Jun. 21, 2011

(87) PCT Pub. No.: WO2010/073209

PCT Pub. Date: Jul. 1, 2010

(65) Prior Publication Data

US 2011/0252543 A1 Oct. 20, 2011

(30) Foreign Application Priority Data

Dec. 22, 2008 (ZA) ..... 2008/10775

(51) Int. Cl.
*A42B 3/20* (2006.01)
*A42B 1/08* (2006.01)

(52) U.S. Cl.
CPC .... *A42B 3/20* (2013.01); *A42B 1/08* (2013.01)

(58) Field of Classification Search
CPC ..... A42B 1/08; A42B 3/20
USPC ..... 2/411, 9, 10, 418, 424, 425, 414, 417, 2/420, 421, 416, 410, 422, 452, 173, 2/171.3; 128/207.11, 201.19, 201.22; 29/428
See application file for complete search history.

(56) References Cited

U.S. PATENT DOCUMENTS

| | | | | | |
|---|---|---|---|---|---|
| 1,868,926 | A * | 7/1932 | Tatore et al. | ..... | 2/421 |
| 3,729,746 | A * | 5/1973 | Humphrey | ..... | 2/9 |
| 4,086,664 | A * | 5/1978 | Humphrey et al. | ..... | 2/9 |
| 4,390,995 | A * | 7/1983 | Walck | ..... | 2/9 |
| 4,633,531 | A * | 1/1987 | Nimmons | ..... | 2/424 |
| 4,837,866 | A * | 6/1989 | Rector et al. | ..... | 2/424 |
| 4,999,855 | A * | 3/1991 | Brown | ..... | 2/421 |
| 5,249,347 | A * | 10/1993 | Martinitz | ..... | 29/460 |
| 5,694,649 | A * | 12/1997 | Hefling et al. | ..... | 2/418 |
| 5,806,088 | A | 9/1998 | Zide et al. | | |
| 6,292,954 | B1 * | 9/2001 | O'Bradaigh et al. | ..... | 2/424 |
| 2007/0151003 | A1 * | 7/2007 | Shih | ..... | 2/424 |
| 2007/0214537 | A1 * | 9/2007 | Durocher et al. | ..... | 2/9 |

FOREIGN PATENT DOCUMENTS

WO WO 99/38402 A1 8/1999

* cited by examiner

*Primary Examiner* — Danny Worrell
*Assistant Examiner* — Khaled Annis
(74) *Attorney, Agent, or Firm* — Tutunjian & Bitetto, P.C.

(57) ABSTRACT

A helmet grille for a sport helmet having a shell and an inner shock absorbing arrangement, the helmet grille including at least one elongate grille member extending from a rear helmet portion forwardly operatively along a first side of a wearer's face, across a front of the wearer's face, and rearwardly towards the rear helmet portion, substantially to extend at least partially around a wearer's head, and at least one attachment formation attached to at least one end of the at least one elongate grille member and attachable to any one of the shell and the inner shock absorbing arrangement.

1 Claim, 4 Drawing Sheets

SPORT HELMETS

This invention relates to sport helmets. More particularly, the invention relates to a helmet grille and to a sport helmet.

BACKGROUND OF THE INVENTION

The inventor is aware of sport helmets worn by sportsmen to protect their heads from the impact of balls, such as cricket balls, baseball balls and the like. Existing sport helmets comprise a helmet portion with shock absorbing material arranged on an inside of the helmet and a grille portion arranged in front of the helmet to protect the face of the sportsman. The grille portion is attached to the helmet portion of to the shock absorbing material. However, such helmets are prone to transfer shock experienced by a ball hitting the helmet to the head of the wearer. The present invention aims to address this shortcoming.

SUMMARY OF THE INVENTION

According to one aspect of the invention, there is provided a helmet grille for a sport helmet having a shell and an inner shock absorbing arrangement, the helmet grille including at least one elongate grille member extending from a rear helmet portion forwardly operatively along a first side of a wearer's face, across a front of the wearer's face, and rearwardly towards the rear helmet portion, substantially to extend at least partially around a wearer's head; and at least one attachment formation attached to at least one end of the at least one elongate grille member and attachable to any one of the shell and the inner shock absorbing arrangement.

At least one elongate grille member may be in the form of a spiral extending circumferentially at least once or twice around a wearer's head.

More particularly, the grille member may be in an elliptical shape, that encircles the wearer's head, the key objective is to disperse the impact of the collision ball hitting the grille over 360° around the wearer's head. It has the added advantage of protecting the wearer behind his ears.

At least one elongate grille member may extend at least three times around a wearer's head.

The spiral portions in front of the helmet may be spaced apart laterally. It is to be appreciated that the spiral may extend around the wearer's head any number of times.

The helmet grille may include at least three elongate grille members laterally spaced apart. The three elongate grille members may extend substantially circumferentially around a wearer's head in the same manner as set out above.

The helmet grille may include a grille member extending over a wearer's head to connect grille members on the left hand side to grille members on the right hand side of the wearer's head.

The helmet grille may include at least one forehead grille member extending across a wearer's face above a wearer's eyebrows.

The forehead grille member may extend substantially around a wearer's head.

The at least one elongate grille member may be of any one of steel, a synthetic plastic material, and a composite material, such as carbon fibre, or the like.

The at least one attachment formation may include a shock absorbing arrangement, in use, to dissipate energy being transferred from the elongate grille member to one of the shell and the inner shock absorbing arrangement.

The attachment formation may include at least one grille mounting to which the at least one grille member is mountable and at least one helmet mounting for mounting to any one of the shell and the inner shock absorbing arrangement.

The attachment formation may be of a synthetic material such as plastic, polyurethane, or the like.

The helmet grille may include three attachment formations, one rear attachment formation which is mountable to the rear of the helmet, and two side attachment formations which are mountable on the sides of the helmet.

The grille mounting of the rear attachment formation may be displaceably attachable to the at least one elongate grille member and the grille mountings of the side attachment formations may be displaceably mounted to the at least one grille member so as to allow the at least one grille member to be displaceable in an operative fore- and aft-direction.

The side attachment formations may be arranged to retain the grille members in lateral spaced relationship with each other.

The rear attachment formation may retain the grille members in position relative to any one of the shell and the inner shock absorbing arrangement. The rear attachment formation may be constructed to permit restricted sideways movement of the grille members.

In use, when the grille members are subjected to shock caused by a ball hitting the helmet grille, the rear attachment formation may absorb a portion of the shock and limit the shock being transferred to wearer's head via any one of the shell and the inner shock absorbing arrangement.

Preferably, the at least one grille member may be adjustable.

The invention extends to a sport helmet, which includes a helmet grille as described.

The sport helmet may include a visor being provided with shock absorption material, provided above the peak of the helmet.

The invention will now be described, by way of example only with reference to the following drawing(s):

DRAWING(S)

In the drawing(s):

EMBODIMENT OF THE INVENTION

Figure 1:
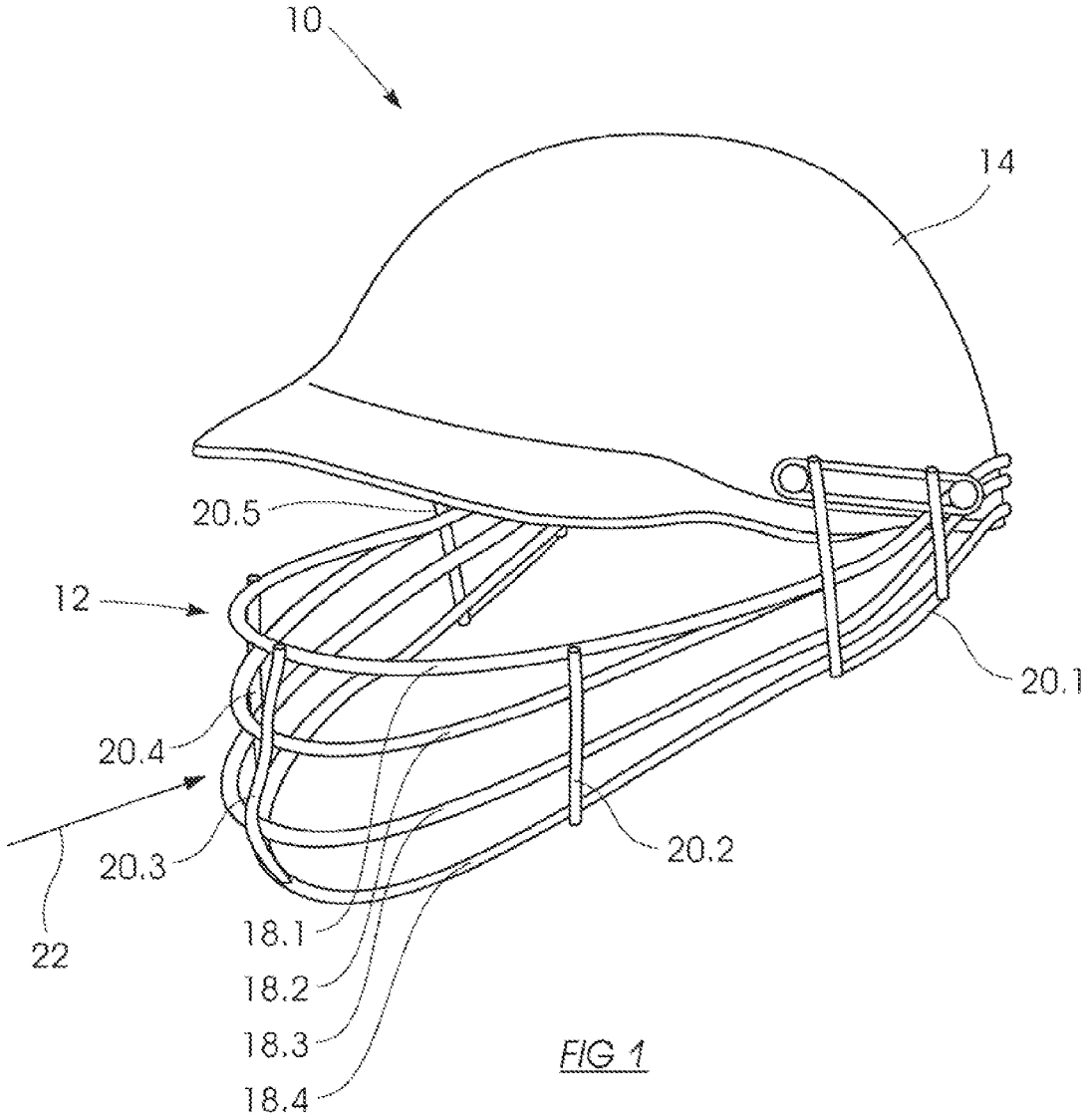
FIG. 1 shows a three dimensional view from the front of a sport helmet in accordance with one embodiment of the invention.
Figure 2:
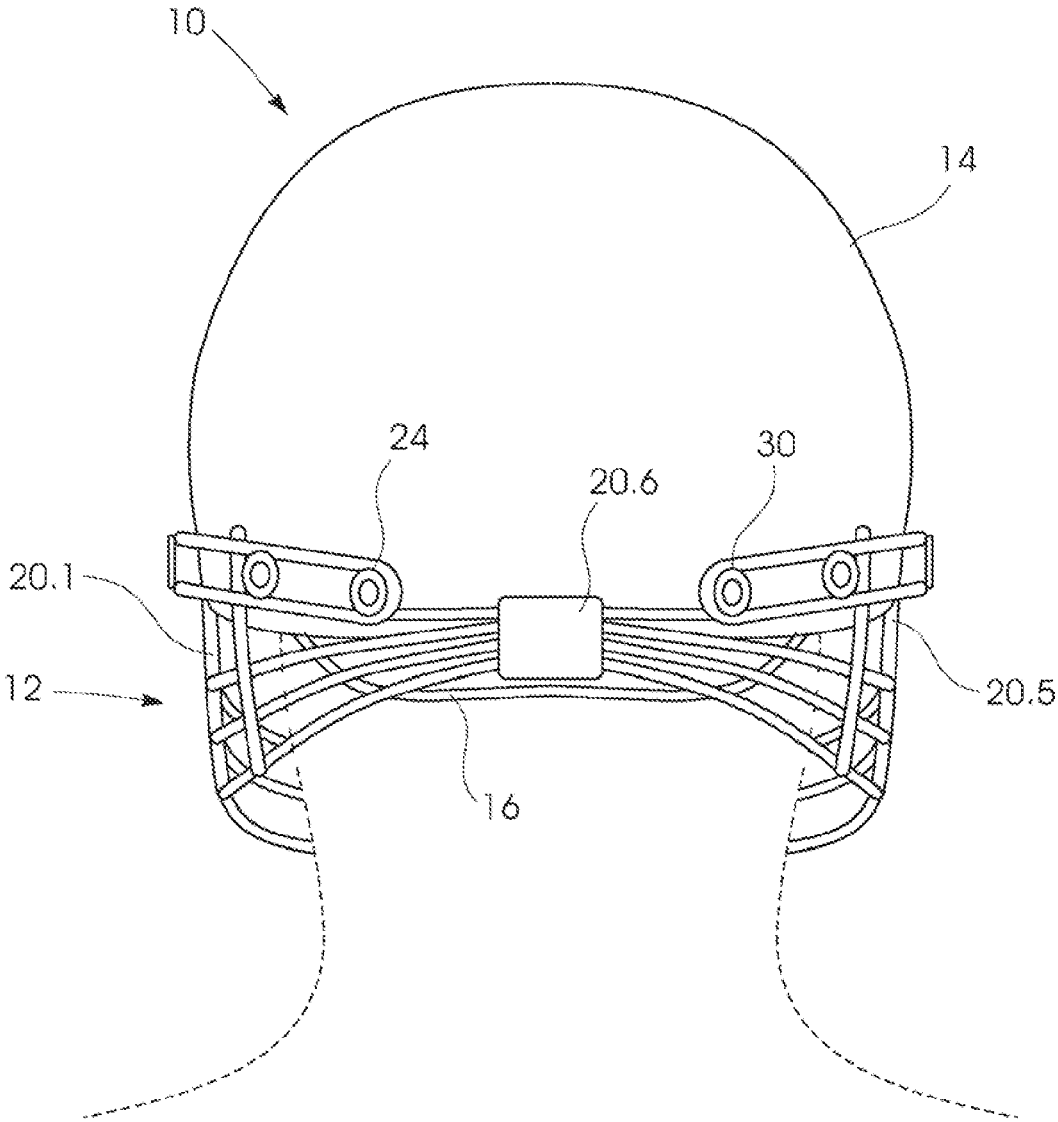
FIG. 2 shows a rear view of the sport helmet of FIG. 1.

FIGS. 1 and 2 show a sport helmet 10 in accordance with one aspect of the invention. The helmet 10 includes a helmet grille 12 in accordance with another aspect of the invention.

The sport helmet 10 comprises a helmet shell 14 and an inner shock absorbing arrangement in the form of a shock absorbing lining 16 (see FIG. 2).

The helmet grille 12 has laterally spaced elongate grille members 18.1 to 18.4 and three attachment formations 20.1, 20.5 and 20.6.

The elongate grille members 18.1, 18.3 and 18.4 extend from a rear helmet portion where they are rigidly attached to the rear attachment formation 20.6. The elongate grille members 18.1 to 18.4 then extends forwardly operatively along a first side of a wearer's face, where they are mounted to a side attachment formation 20.1 which is displaceably mounted onto the helmet shell 14 by means of doughnut shaped shock absorption mountings 24, 26. The elongate grille members 18.1 to 18.4 then extends across a front of the wearer's face, and rearwardly along a second side of a wearer's face, where they are mounted to a side attachment formation 20.5, which is also displaceably mounted onto the helmet shell 14 by means of doughnut shaped shock absorption mountings 28, 30. The elongate grille members 18.1, 18.3 and 18.4 then extend rearwardly towards the rear helmet portion where they are again displaceably attached to the rear attachment formation 20.6. The elongate grille members 18.1, 18.3 and 18.4 are attachably mounted in the rear attachment formation 20.6 to adjust their effective length. As can be seen in FIGS. 1 and 2, when in use, the elongate grille members extend substantially around a wearer's head.

The helmet grille 12 has three cross members 20.2, 20.3 and 20.4 attached to the grille members 18.1 to 18.4. The cross members 20.2 to 20.4 retains the grille members 18.1 to 18.4 in laterally spaced relationship to each other when a shock is exerted on the grille members 18.1 to 18.4. In particular, when the shock is caused by an unequal force on one or more of the grille members 18.1 to 18.4, the shock is distributed across the members 18.1 to 18.4.

The attachment formations 20.1, 20.5 and 20.6 are attached to the helmet shell 14. Therefore, any shock exerted on the helmet grille 12 will be transferred to the helmet shell.

However, as the grille members 18.1 to 18.4 are displaceable in a fore- and aft-direction relative to the helmet shell 14 via the side attachment formations 20.1, 20.5, any shock experienced from an operative front side of the helmet in the direction of arrow 22, will not only be absorbed by the side attachment formations 20.1, 20.5, but will also be transferred to the rear attachment formation 20.6.

In use, shock exerted in the direction of arrow 22, will be partially transferred via the side attachment formations 20.1, 20.5 to the rear attachment formation 20.6, which in turn will dissipate an amount of the energy before transferring the shock to the helmet shell 14. The resultant shock exerted on the helmet shell 14 will be further absorbed by the shock absorbing lining 16 before any resultant shock will be transferred to a wearer's head.

The grille members 18.1, 18.3 and 18.4, which are mounted onto the rear attachment formation 20.6, are displaceable in a longitudinal direction in the rear attachment formation 20.6.

Figure 3:
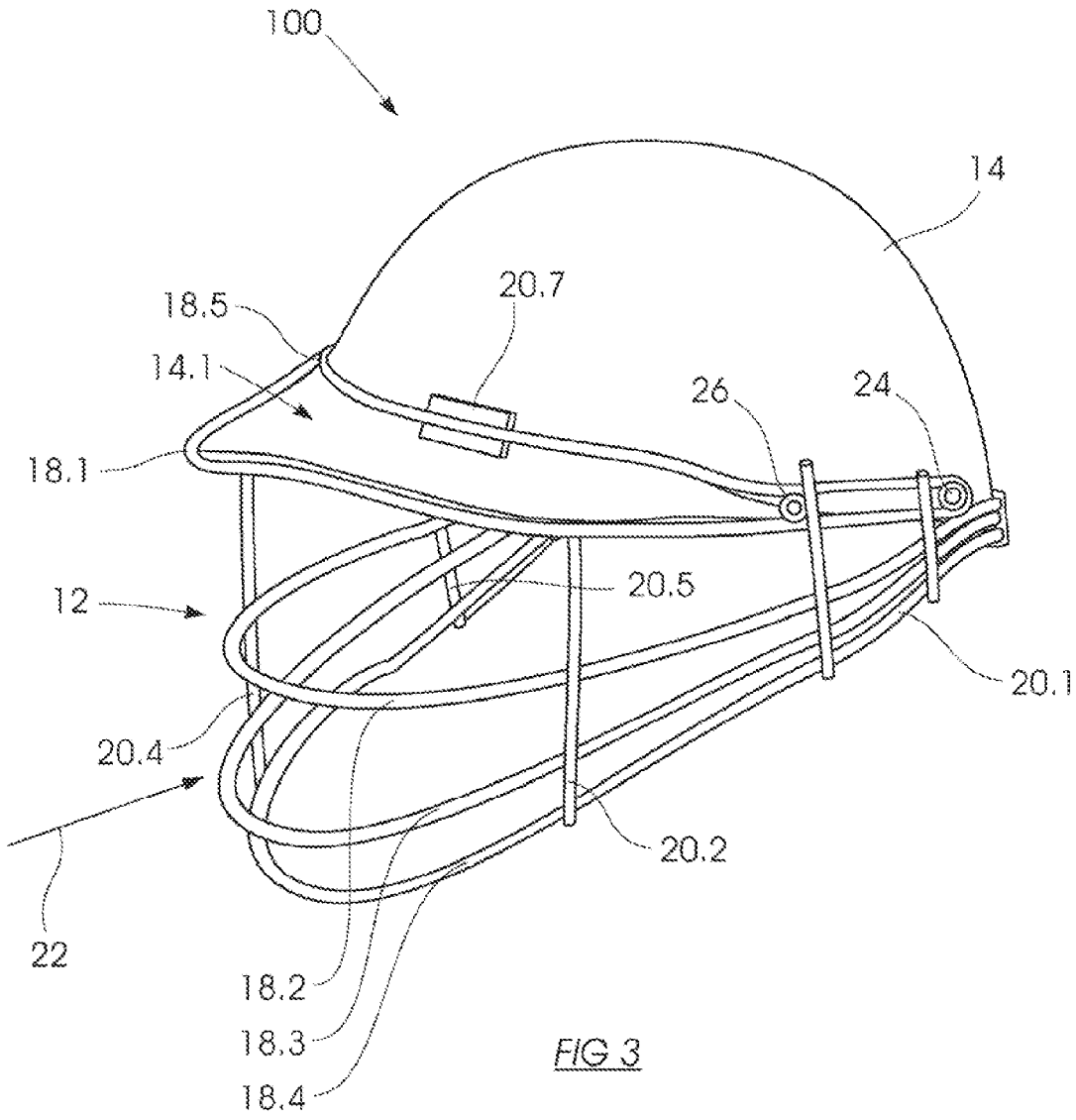
FIG. 3 shows a three dimensional view from the front of a sport helmet in accordance with another embodiment of the invention.

In FIG. 3, another embodiment of the invention is shown. The helmet 100 in FIG. 3 is the same as the helmet shown in FIG. 1, with same numerals used for same or similar components.

The grille members 18.1 to 18.4 of the helmet 100 are differently spaced in front of a wearers head and includes an additional grille member 18.5 above the eyes above a visor 14.1. The grille member 18.5 extends 360° around the wearer's head. The purpose of the 360° grille member 18.5 is to distribute a shock caused by a ball hitting the helmet above the eyes over the full circumference of the helmet 14. An additional attachment formation 20.7 is provided to retain the grille member 18.5 in position.

Figure 4:
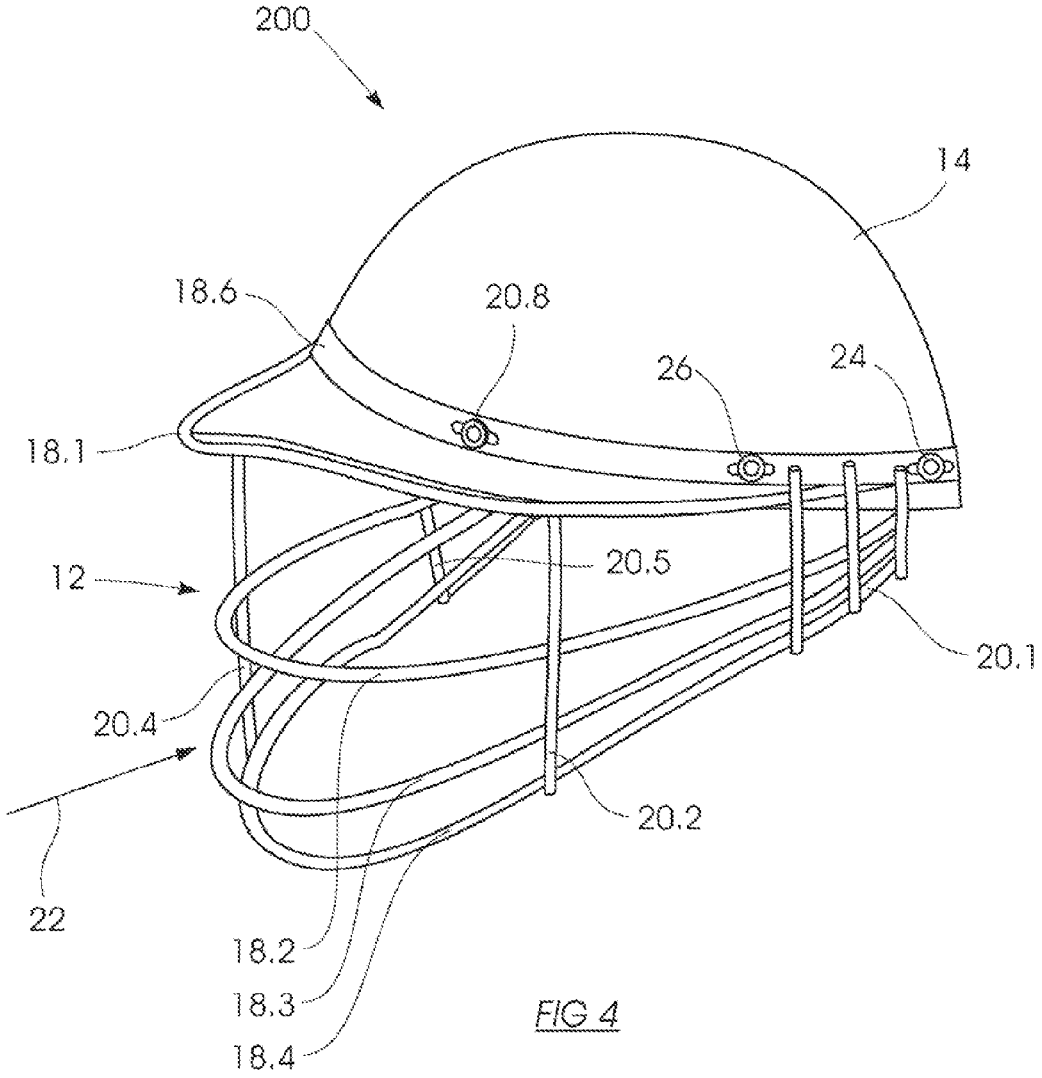
FIG. 4 shows a three dimensional view from the front of a sport helmet in accordance with yet another embodiment of the invention.

In FIG. 4, another embodiment of the invention is shown. The helmet 200 in FIG. 4 is the same as the helmet shown in FIG. 1, with same numerals used for same or similar components.

The spacing of the grille members 18.1 to 18.4 is the same as the helmet 100, but the grille member 18.5 of the helmet 100 is replaced with a full band 18.6 extending around the wearer's head. The grille members 18.1 to 18.4 are attached to the band 18.6, which are attached to the helmet with shock absorbing mountings. The attachment formation 20.8 is of the same shock absorbing arrangement as the attachment formations 24, 26, 28, 30. It is to be appreciated that the band 18.6 transfers the shock over the full circumference of the helmet. This invention covers all helmet grille members where the shock from a cricket or baseball ball is absorbed by a grille mounting, instead of being transferred to the helmet shell, to be absorbed by an inner lining.

It is to be appreciated that further improvements on the helmet, not shown in this example, may include the extension of grille members or attachment formations onto the upper side of the helmet.

The inventor believes that the sport helmet and helmet grille in accordance with the invention have substantial advantages over existing sport helmets of which the inventor is aware. In particular, the inventor believes, in a sport such as cricket or baseball, the shock transferred to a wearer's head can be reduced by the invention set out in the specification.

The invention claimed is:

1. A sport helmet comprising:

a helmet shell adapted to engage with a wearer's head;

an inner shock absorbing arrangement located between the helmet shell and the wearer's head;

a grill arrangement comprising a plurality of elongate grill members laterally spaced apart from one another, wherein each grill member extends 360° around the helmet shell and the wearer's head; and a plurality of attachment formations designed to attach the elongate grill members to the helmet shell, including at least first and second attachment formations located respectively on first and second sides of the helmet shell which maintain the grill members in a laterally spaced apart relationship from each other when the helmet is worn and a third attachment formation located on a rear portion of the helmet shell which maintains a position of the grill members relative to the shell when the helmet is worn;

wherein the first and second attachment formations are displaceably mounted to at least one grill member to allow the at least one grill member to be displaceable in a fore and aft direction; and the third attachment formation is displaceably mounted to at least one grill member to permit sideways movement of the at least one grill member; and wherein at least one attachment formation of the plurality of attachment formations includes a shock absorbing mounting which absorbs and dissipates shock, and which transfers shock exerted on the grill arrangement to the helmet shell over a circumference of the helmet shell and to the inner shock absorbing arrangement.

* * * * *